US012515909B2

(12) United States Patent
Lampaert et al.

(10) Patent No.: US 12,515,909 B2
(45) Date of Patent: Jan. 6, 2026

(54) YARN FEED MODULE

(71) Applicant: VANDEWIELE NV, Kortrijk/Marke (BE)

(72) Inventors: Vincent Lampaert, Vichte (BE); Frank Callens, Oostrozebeke (BE)

(73) Assignee: VANDEWIELE NV, Kortrijk/Marke (BE)

( * ) Notice: Subject to any disclaimer, the term of this patent is extended or adjusted under 35 U.S.C. 154(b) by 742 days.

(21) Appl. No.: 17/615,805

(22) PCT Filed: Jun. 3, 2020

(86) PCT No.: PCT/IB2020/055218
§ 371 (c)(1),
(2) Date: Dec. 1, 2021

(87) PCT Pub. No.: WO2020/250085
PCT Pub. Date: Dec. 17, 2020

(65) Prior Publication Data

US 2022/0297972 A1 Sep. 22, 2022

(30) Foreign Application Priority Data

Jun. 12, 2019 (BE) ..... 2019/5373

(51) Int. Cl.
*B65H 51/06* (2006.01)
*B65H 57/02* (2006.01)
*D05C 15/18* (2006.01)

(52) U.S. Cl.
CPC ..... *B65H 51/06* (2013.01); *B65H 57/02* (2013.01); *D05C 15/18* (2013.01); *B65H 2701/31* (2013.01)

(58) Field of Classification Search
CPC ..... B65H 51/10; B65H 51/06; B65H 51/08; B65H 51/04; B65H 2404/62;
(Continued)

(56) References Cited

U.S. PATENT DOCUMENTS 3,095,841 A * 7/1963 Ballard ..... D05C 15/32 112/80.54
3,103,903 A * 9/1963 Broadrick ..... D05C 15/32 226/110
(Continued)

FOREIGN PATENT DOCUMENTS

CN 1164218 A 11/1997
CN 203653893 U 6/2014
(Continued)

OTHER PUBLICATIONS

International Search Report, PCT/IB2020/055218, Mailing Date Jul. 16, 2020.
(Continued)

*Primary Examiner* — Anna M Momper
*Assistant Examiner* — Katelynne R Burrell
(74) *Attorney, Agent, or Firm* — FRESH IP PLC; Clifford D. Hyra; Aubrey Y. Chen

(57) ABSTRACT

The invention concerns a yarn feed module for supplying yarn into a textile machine, including a drive roller for supplying the yarn, a guide element for guiding the yarn, and a restrain element that is arranged between the drive roller and the guide element in order to ensure that, on supplying of the yarn, the yarn detaches from the drive roller. The invention also concerns a textile machine including such a yarn feed module.

12 Claims, 8 Drawing Sheets

(58) Field of Classification Search
CPC ..... B65H 2404/622; B65H 2404/511; B65H 2404/121; B65H 2404/12; B65H 2404/1421; B65H 57/02; B65H 2701/31; B65H 2601/273; B65H 59/12; D05C 15/18; D05C 11/18; D05C 15/00; D05C 15/04; D05C 15/08; D05C 15/10; D05C 15/32; D05C 11/00; D05C 11/08
USPC ..... 226/187
See application file for complete search history.

(56) References Cited

U.S. PATENT DOCUMENTS

| | | | | | |
|---|---|---|---|---|---|
| 3,361,096 | A * | 1/1968 | Watkins | D05C 15/00 | 112/80.15 |
| 3,380,414 | A * | 4/1968 | Gray | D05C 15/04 | 112/80.5 |
| 3,489,326 | A * | 1/1970 | Singleton | D05C 15/32 | 226/188 |
| 4,285,285 | A * | 8/1981 | Chambers | D05C 15/18 | 139/452 |
| 4,598,560 | A | 7/1986 | Sawazaki | | |
| 6,907,721 | B2 * | 6/2005 | Zewde | D02G 3/445 | 57/22 |
| 8,127,698 | B1 * | 3/2012 | Ingram | D05B 47/00 | 112/80.7 |
| 12,068,568 | B2 * | 8/2024 | Weber | B65H 51/10 | |
| 2004/0118099 | A1 | 6/2004 | Zewde et al. | | |

FOREIGN PATENT DOCUMENTS

| | | | | | |
|---|---|---|---|---|---|
| CN | 107522023 | A | | 12/2017 | |
| CN | 108584534 | A | * | 9/2018 | B65H 51/06 |
| CN | 112897206 | A | * | 6/2021 | B65H 51/04 |
| DE | 102007054080 | B3 | | 7/2009 | |
| DE | 102010048521 | A1 | | 4/2011 | |
| DE | 102016015018 | A1 | | 6/2018 | |
| EP | 1126063 | A2 | | 8/2001 | |
| EP | 2029802 | A1 | | 3/2009 | |
| GB | 1011496 | A | * | 12/1965 | D05C 15/32 |
| GB | 1345648 | A | | 1/1974 | |
| GB | 1509309 | A | | 5/1978 | |
| GB | 2026554 | A | | 2/1980 | |
| GB | 2078792 | A | | 1/1982 | |
| GB | 2210901 | A | | 6/1989 | |
| JP | 2018177497 | A | * | 11/2018 | B65H 59/12 |
| KR | 20010110238 | A | | 12/2001 | |
| WO | WO2008131252 | A1 | | 10/2008 | |
| WO | 2012146119 | A1 | | 11/2012 | |
| WO | 2013088233 | A1 | | 6/2013 | |
| WO | 2016162372 | A1 | | 10/2016 | |

OTHER PUBLICATIONS

Supplementary Search Report issued for CN 2020800320215, mailing date of Apr. 11, 2024.

* cited by examiner

YARN FEED MODULE

FIELD OF THE DISCLOSURE

The disclosure concerns a yarn feed module for supplying yarn into a textile machine under a yarn tension according to a supply direction, comprising:

- a drive roller which is drivable for supplying the yarn and configured such that the yarn is provided to detach from the drive roller on a side of the drive roller where said drive roller is arranged so as to be free;
- a guide element which is arranged behind the drive roller viewed in the supply direction in order, during supplying of the yarn, to guide the yarn by contact therewith so that the supply direction is adjusted by the guide element.

BACKGROUND

Yarn feed modules are known for example from U.S. Pat. No. 6,807,917 B1 for supplying yarn into a tufting machine, and from WO 2017/006226 A1 for feeding warp or pile yarn into a textile machine, such as a tufting machine or a weaving machine. Such yarn feed modules are used in all types of textile machines, such as tufting machines, carpet weaving machines, velvet weaving machines, wire weaving machines, and flat weaving machines.

SUMMARY

In the present disclosure, yarn is taken from a yarn storage system and supplied into a yarn pick-up system. The yarn storage system is typically a bobbin creel. The yarn pick-up system may be the weaving zone in a weaving machine or an intermediate storage site for yarn or the tufting needles of a tufting machine.

The yarn here is not supplied between a drive roller and a pressure roller pressed against this, as described for example and depicted in U.S. Pat. No. 4,285,285 A or US 2004/0118099 A1, wherein the yarn detaches from the drive roller where the drive roller is pressed against the pressure roller. The yarn detaches from the drive roller on a side of the drive roller where the drive roller is arranged so as to be free.

To supply the yarn with such a yarn feed module along a yarn path, the drive roller must have sufficient grip on the yarn to be able to drive the yarn. For this, the mantle surface of such a drive roller typically has a degree of roughness in order to avoid slippage of the yarn over this mantle surface.

Behind the drive roller, said guide element actively helps determine the yarn path and for this adjusts the supply direction of the yarn by guiding said yarn by contact therewith in order to force the yarn to follow the desired yarn path.

Because the yarn is picked up further along the yarn path by the yarn pick-up system, the yarn is picked up under a certain yarn tension.

However, filaments of yarn may stick (this also includes: may be hooked) to the drive roller during supplying of the yarn. These filaments do not detach at the desired moment and are not supplied along with the rest of the yarn. The yarn pick-up system then no longer picks up the desired yarn, but only part thereof. The filaments which stick to the drive roller disrupt the further supply of the yarn.

It is also possible that the yarn pick-up system further along the yarn path, at a specific moment, is still scarcely pulling the yarn and the yarn remains completely stuck to the drive roller. This may even lead to a breakage of the yarn.

This is for example possible in variants of tufting machines which do not comprise puller rollers, such as the puller rollers (20) described in U.S. Pat. No. 6,807,917 B1. If a yarn of a specific colour is not used, the yarn may hang more loosely in such a tufting machine. This is for example also possible in weaving machines if, in periods of recuperation, the pile-warp yarn hangs loosely due to a change in shed position.

In various textile machines, solutions have already been proposed for preventing the yarn from sticking to a drive roller.

DE 10 2010 048521 A1 for example describes a proactive method of preventing yarn from sticking to a drive roller by providing a detaching unit for this drive roller.

In KR 2001 01 10238 A, an auxiliary roller is arranged in the vicinity of the drive roller, and the yarn is supplied around the drive roller and auxiliary roller such that the problem of sticking of the yarn is limited.

In EP 1 126 063 A2, a vibration generator is provided to prevent the yarn from sticking on the drive roller.

The object of the disclosure is to provide a yarn feed module which, in a simpler manner, prevents at least part of a supplied yarn from being able to stick on the drive roller.

The object of the disclosure is achieved by providing a yarn feed module for supplying yarn into a textile machine under a yarn tension according to a supply direction, comprising:

- a drive roller which is drivable for supplying the yarn and configured such that the yarn is provided to detach from the drive roller on a side of the drive roller where said drive roller is arranged so as to be free;
- a guide element which is arranged behind the drive roller viewed in the supply direction in order, during supplying of the yarn, to guide the yarn by contact 10 therewith so that the supply direction is adjusted by the guide element; and
- a restrain element which, viewed in the supply direction, is arranged between the drive roller and the guide element in order to ensure that the yarn detaches from the drive roller on supplying of the yarn.

The restrain element ensures that on supplying of the yarn, the yarn detaches from the drive roller so as to prevent at least part of the yarn from sticking to the drive roller. Using such a restrain element, all filaments which stick to the drive roller and do not detach from the drive roller at the desired moment are forcibly separated from the surface of the drive roller, so that these filaments can be supplied further with the rest of the yarn. Also, complete yarn which does not detach at the desired moment but sticks to the mantle surface of the drive roller is thus separated from the drive roller by means of such a restrain element and supplied further. The restrain element ensures that the filaments (or yarn) do (does) not continue to turn with the drive roller.

Such a restrain element may be arranged completely next to the yarn path which the yarn normally mainly follows on supply of said yarn.

Alternatively, it is also possible that the restrain element is arranged at least partially around the yarn path, wherein the yarn is supplied for example through an eye of the restrain element. Such embodiments are less advantageous since the yarn is then more difficult to arrange.

To ensure that the yarn (or filaments thereof) detaches (detach) from the drive roller, under a reduced yarn tension and/or if filaments of the yarn or the entire yarn remain/remains stuck to the drive roller, the yarn makes contact with the restrain element.

Possible contact points between the yarn and the restrain element for detaching the yarn together form a restrain surface. The actual contact which is made between the yarn and the restrain element, for detaching the yarn from the drive roller, typically takes the form of a point or line. These possible point-like or linear contacts together form the restrain surface.

Said restrain surface is preferably designed smooth.

Said restrain surface is preferably mainly arranged on the same side of the yarn path as the drive roller. The majority of said restrain surface is then arranged on this side of the yarn path.

If the drive roller is arranged so as to be rotatable around a rotation axis, and if, viewed in a projection plane perpendicular to the rotation axis, during supplying of the yarn, the yarn is supplied between the drive roller and the guide element approximately along a common tangent of the drive roller and guide element, then viewed in the projection plane, said restrain surface of the restrain element is preferably arranged mainly on the same side of said tangent as the drive roller.

A small part of the restrain surface may also be arranged partially on the other side of the tangent, as long as the majority thereof is arranged on the same side of the tangent. Preferably however, said restrain surface is arranged completely on the same side of said tangent as the drive roller. Such a restrain element may be designed more simply.

There are several common tangents of the drive roller and guide element. Said common tangent coincides approximately with the yarn path which the yarn follows during supply thereof. The yarn path may also (temporarily) deviate slightly from this tangent. The yarn path may deviate for example when the yarn, even during supplying of the yarn, makes contact with the restrain element, wherein the restrain element shifts the yarn path slightly relative to this tangent.

The drive roller is preferably substantially cylindrical with a radius r.

The restrain surface of the restrain element is preferably arranged at an intermediate distance t from said common tangent, wherein t≤radius r of the drive roller. A positive distance here means that the restrain surface lies on the same side of the tangent as the drive roller.

This intermediate distance may also be negative as long as, viewed in the projection plane, the restrain element is arranged mainly on the same side of the tangent as the drive roller. In this case, the restrain element also fulfils a guide function for guiding the yarn between the drive roller and said known guide element which is arranged further away from the drive roller.

Preferably however, a positive intermediate distance is selected so that the restrain element has no influence on the supply of the yarn. Contact is then made with the yarn only when the yarn (or filaments thereof) remains (remain) stuck to the drive roller after the normal detachment point, and rotates (rotate) with the drive roller until said yarn (or filaments thereof) comes (come) into contact with the restrain element. In such a case, the restrain element is arranged such that on supplying of the yarn, when the yarn tension remains above a supply yarn tension, the restrain element allows the unhindered supplying of the yarn. In contrast for example to said puller rollers, the restrain element does not exert a secondary yarn tension on the yarn, so that the yarn cannot be damaged as easily.

Preferably, with respect to the yarn path, the intermediate distance is always positive (at least 0) and this intermediate distance is preferably also limited to maximum the radius r of the drive roller.

The restrain element is namely preferably arranged as closely as possible to the yarn, so that it can detach the yarn (or filaments thereof) from the drive roller as quickly as possible. Preferably, this restrain element is arranged at a location which the yarn does not normally reach during supply, i.e. at a positive intermediate distance (greater than 0) with respect to the yarn path.

The point of the restrain element which is arranged closest to said common tangent is preferably at a distance x from the contact point of said tangent with the drive roller, wherein this distance x≤half the distance y from the contact point of the tangent with the drive roller to the contact point of the guide element with the tangent. The distance x is even more preferably≤one quarter of the distance y, and most preferably≤one tenth of the distance y.

The closer the restrain element is arranged to the drive roller, the more quickly the restrain element may ensure that the yarn (or filaments thereof) detaches (detach) from the drive roller, and the more effectively it works.

The restrain surface of the restrain element is preferably arranged mainly parallel to the rotation axis of the drive roller.

The restrain element here preferably extends almost over the complete height of said drive roller (in the direction of the rotation axis). In this way, the same effect of the restrain element can be guaranteed over the complete height of the drive roller.

The restrain element is preferably designed so as to be convex on its side pointing towards said common tangent.

In an embodiment which is easy to produce, the restrain element is configured as a pin.

In a specific embodiment, viewed in cross-section in a section perpendicular to the rotation axis, the restrain element is wedge-shaped so as to drive a wedge between the drive roller and the yarn.

The restrain element is preferably arranged fixedly. A fixed installation allows the restrain element to be positioned more closely to the drive roller.

The distance of the restrain element from the drive roller is preferably selected smaller than the diameter of the yarn to be supplied.

In a specific embodiment, the yarn feed module comprises a carrier element, which is displaceable relative to the drive roller, and comprises a drive-back element for exerting a force on the carrier element in order to drive said carrier element towards the drive roller, and comprises a guide roller which is arranged on the carrier element so as to be freely rotatable around a rotation axis in order, when the carrier element is driven towards the drive roller by the drive-back element, to clamp the supplied yarn between the drive roller and the guide roller The restrain element prevents the yarn (or filaments thereof) from being carried by the drive roller until this yarn (or filaments thereof) would pass between the drive roller and guide roller for a second time.

If such a guide roller is provided, the restrain element is preferably arranged in a zone between said common tangent and said guide roller.

In a particular embodiment, the restrain element is arranged on such a carrier element. Existing yarn feed modules in which such a guide roller is provided on such a carrier element may then simply be converted into a yarn feed module according to this disclosure by replacing said carrier element by a carrier element provided with a restrain element.

The object of this disclosure is furthermore also achieved by providing a textile machine which comprises a yarn feed module according to this disclosure as described above. Such a textile machine may for example be configured as a tufting machine or as a weaving machine, such as for example a carpet weaving machine, a velvet weaving machine, a wire weaving machine or a flat weaving machine.

BRIEF DESCRIPTION OF THE DRAWINGS

Embodiments of the disclosure will now be explained in more detail with reference to the following description. The aim of this description is exclusively to provide explanatory examples and indicate further advantages and features, and may not therefore be interpreted as restricting the area of application of the disclosure or the patent rights claimed in the claims.

In the description, by means of reference signs, reference is made to the attached drawings in which.

DETAILED DESCRIPTION

Figure 1:
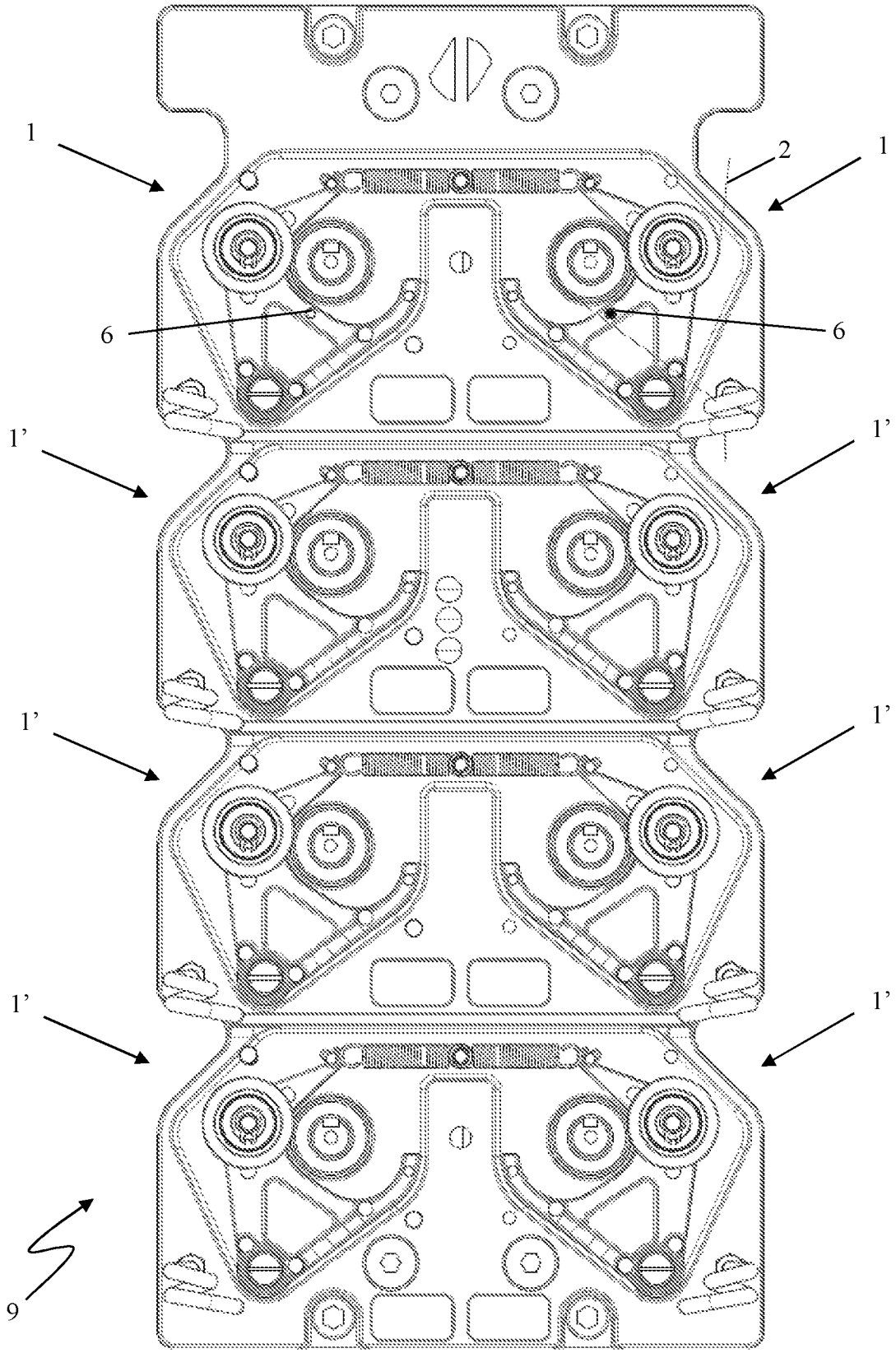
FIG. 1 shows a front view of a feed device with various yarn feed modules, including a first embodiment of a yarn feed module according to this disclosure.

The yarn feed modules (1) shown each comprise, per supplied yarn (2), a drive roller (3) which is arranged so as to be rotatable around a rotation axis (R) and a motor (10) for driving said drive roller (3). By means of the drive roller (3), yarn (2) may be picked up from a yarn storage system (not shown) and supplied according to a supply direction (A) to a yarn pick-up system (not shown). Between the drive roller (3) and the yarn pick-up system, a guide element (5) is arranged, by means of which the yarn path 20 followed by the supplied yarn (2) is adjusted in order to ensure that the yarn (2) is kept away from further elements of the yarn feed module (1) or adjacent components, such as e.g. a drive roller (3) from an adjacent yarn feed module (1).

In the embodiment shown, viewed in the supply direction (A), a restrain element (6) is arranged between the drive roller (3) and the guide element (5) in order to ensure, on supplying of the yarn (2), that the yarn (2) detaches from the drive roller (3).

In the embodiment shown, furthermore a carrier element (7) is arranged so as to be rotatable around the rotation axis (T). A guide roller (4) is arranged on this carrier element (7). Springs (8) drive the carrier element (7) towards the drive roller (3) such that the guide roller (4) is clamped against the drive roller (3) in order to clamp the yarn (2) between the drive roller (3) and the guide roller (4). The yarn (2) which is supplied from the yarn storage system is first wound around part of the guide roller (4), arranged between the guide roller (4) and the drive roller (3), and wound around part of the drive roller (3). The yarn (2) is not arranged fully around these rollers (3, 4) but runs only over an arcuate part of their mantle surfaces. Instead of such a carrier element (7) with such a guide roller (4), other means are known for restricting a slippage of the yarn (2) relative to the drive roller (3).

Figure 2:
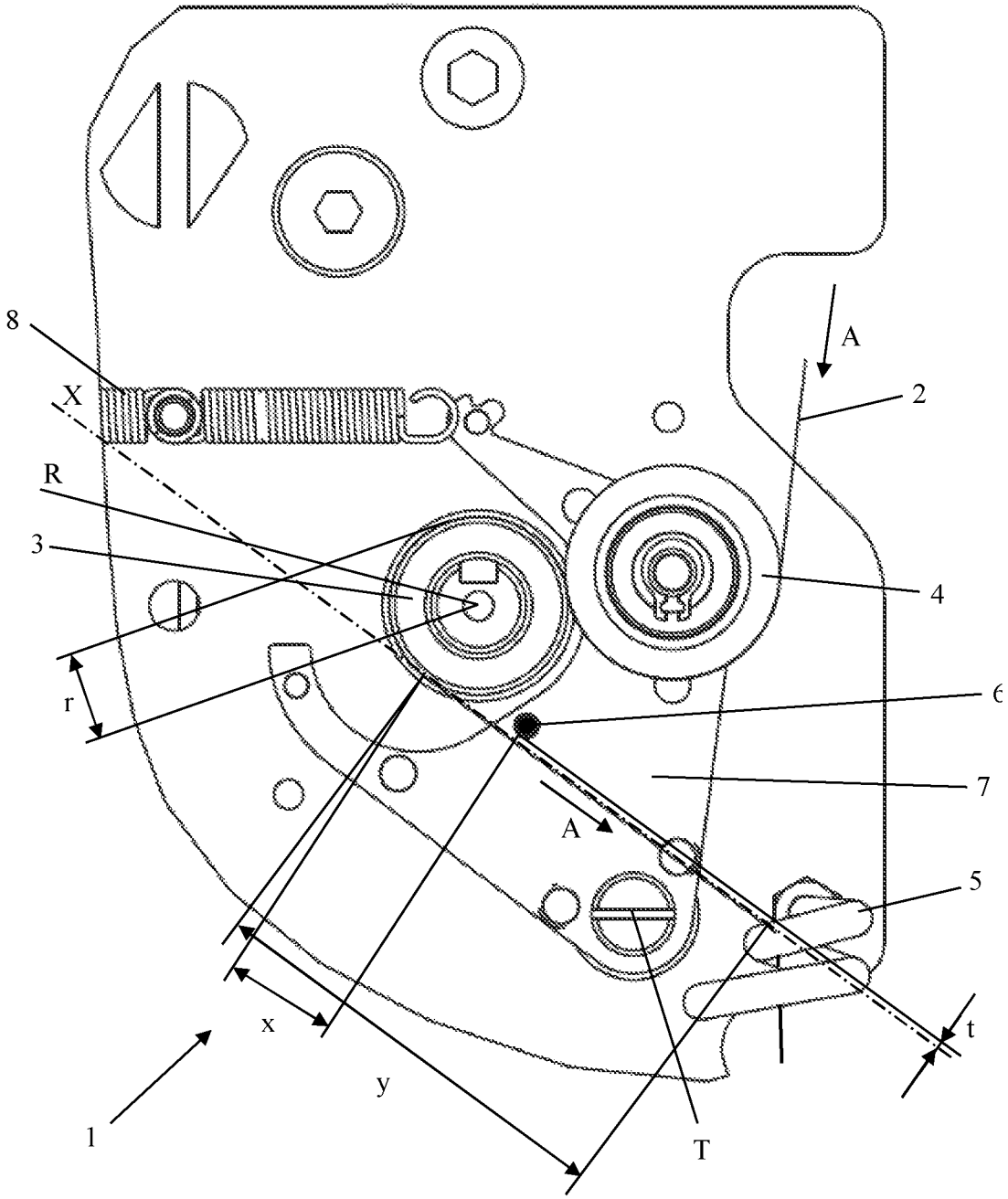
FIG. 2 shows particularly and in more detail a part of the feed device from FIG. 1 at the position of the first embodiment.
Figure 3:
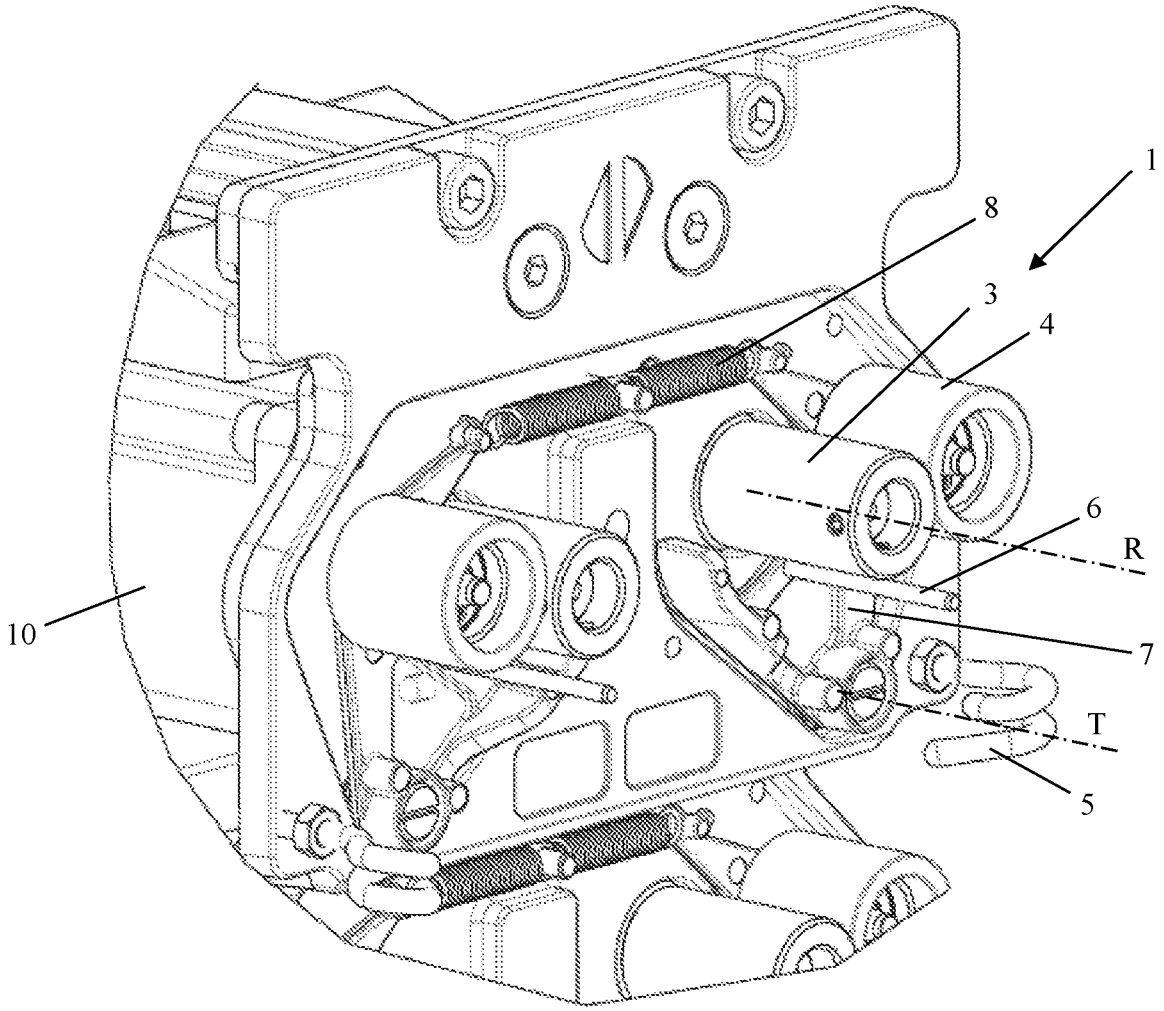
FIG. 3 shows particularly and in perspective a part of the feed device in FIG. 1 at the position of the first embodiment.

At the top of the feed device (9) shown in FIG. 1, six known yarn feed modules (1') according to the prior art are arranged, together with two yarn feed modules (1) according to a first embodiment of the disclosure, which are also shown in more detail in FIGS. 2 and 3. In these yarn feed modules (1) according to the disclosure, the restrain element (6) is configured as a pin which is provided on the carrier element (7). This mainly cylindrical pin is arranged parallel to the mainly cylindrical drive roller (3), so that this is displaceable together with said carrier element (7) relative to the drive roller (3).

Figure 4:
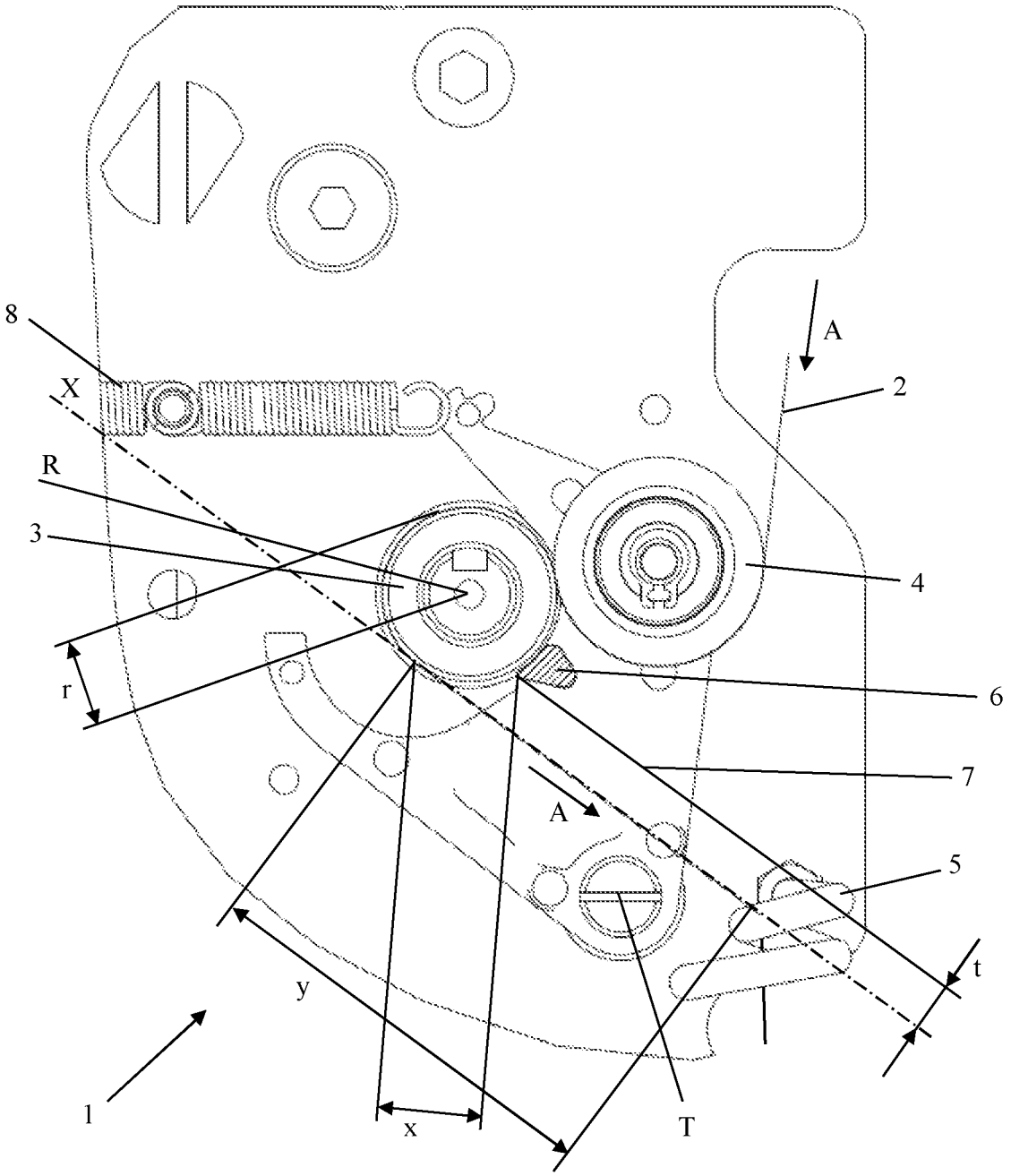
FIG. 4 shows a front view of a part of a feed device at the position of a second embodiment of a yarn feed module according to this disclosure.
Figure 5:
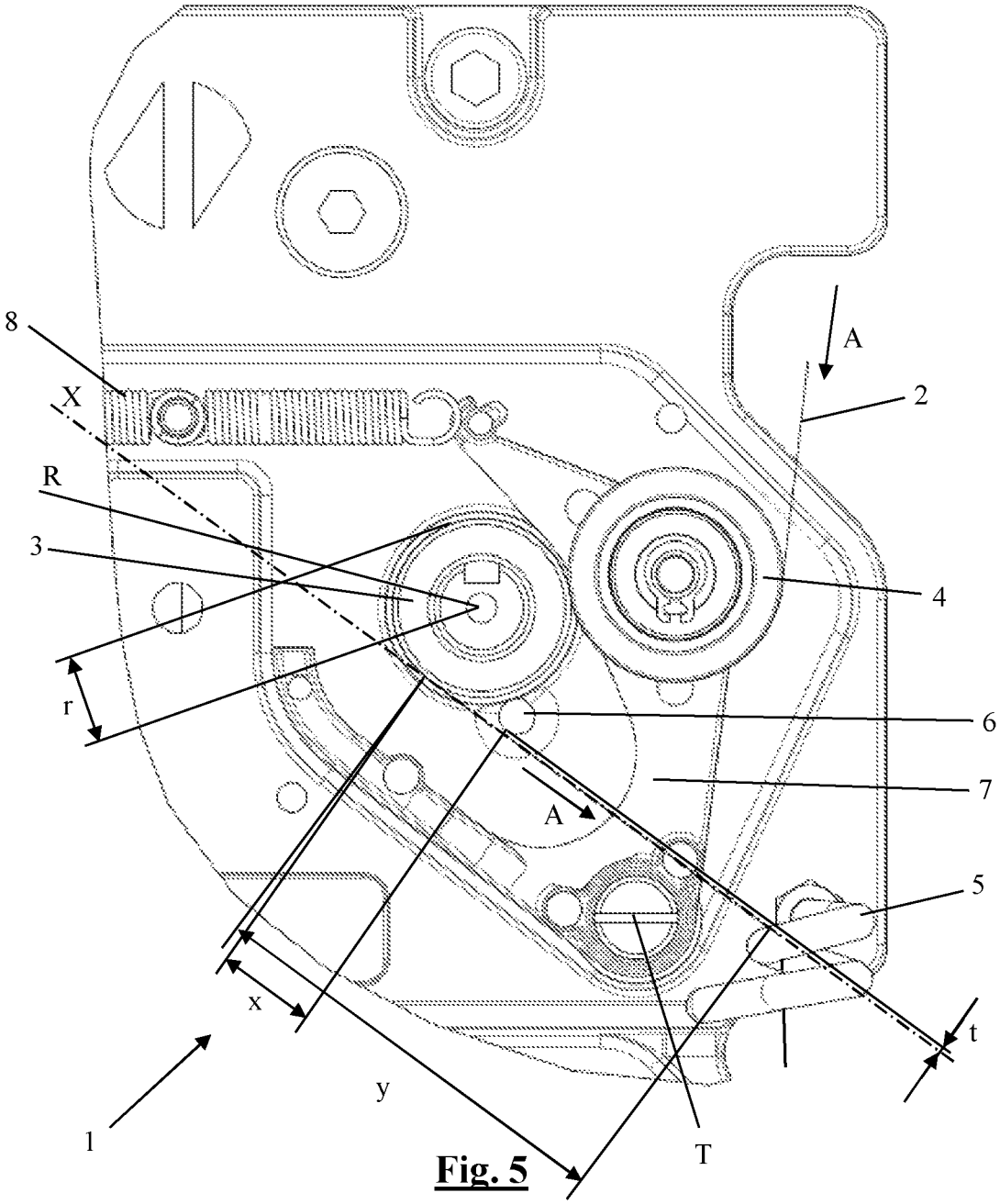
FIG. 5 shows a front view of a part of a feed device at the position of a third embodiment of a yarn feed module according to this disclosure.

In the second embodiment in FIG. 4, the mainly cylindrical pin from the first embodiment is replaced by a pin with a wedge-shaped cross section. In the third embodiment in FIG. 5, the restrain element (6) is again a mainly cylindrical pin which is now provided separately from the carrier element (7) and is arranged fixedly in the yarn feed module (1).

Figure 6:
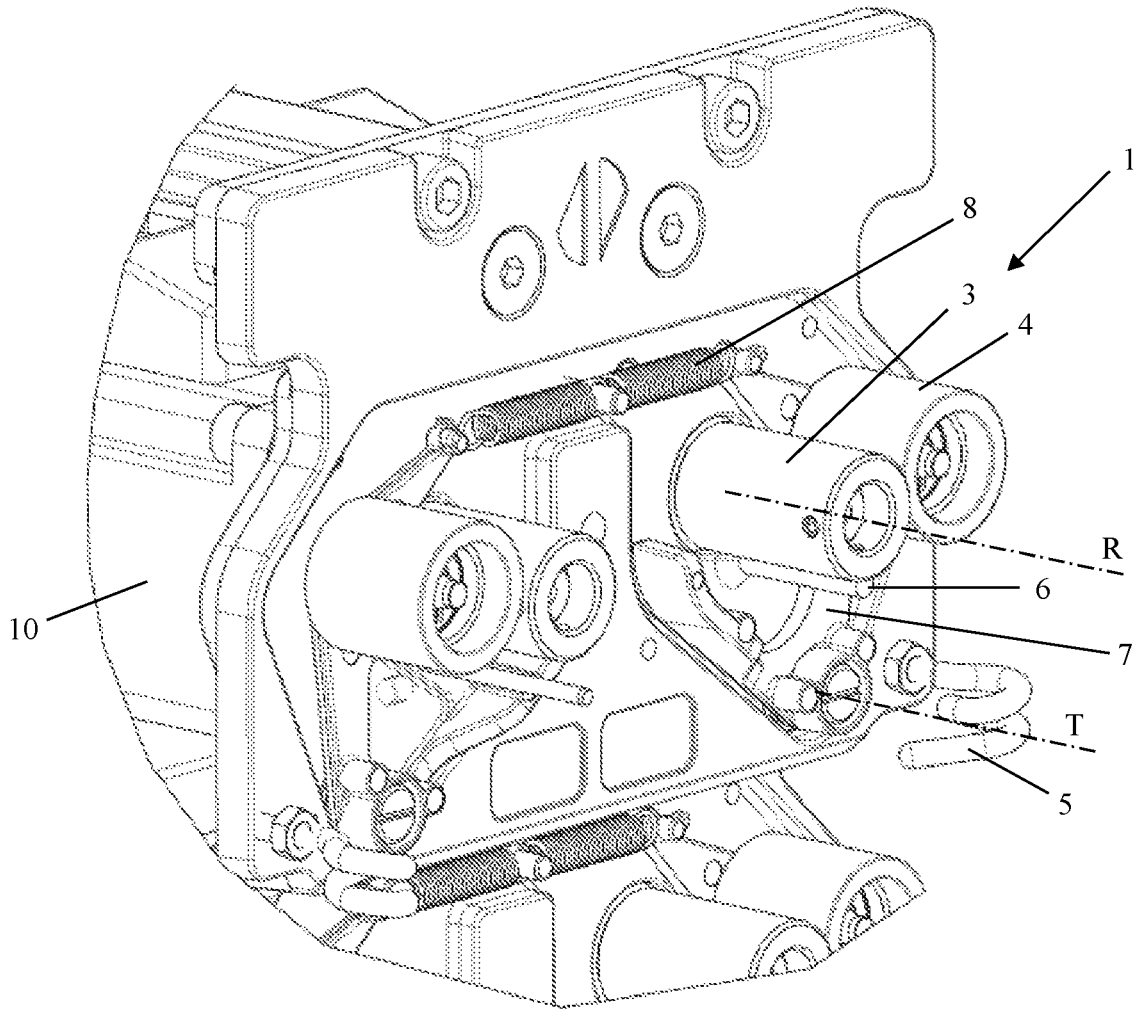
FIG. 6 shows separately and in perspective a part of the feed device from FIG. 5 at the position of the third embodiment.
Figure 7:
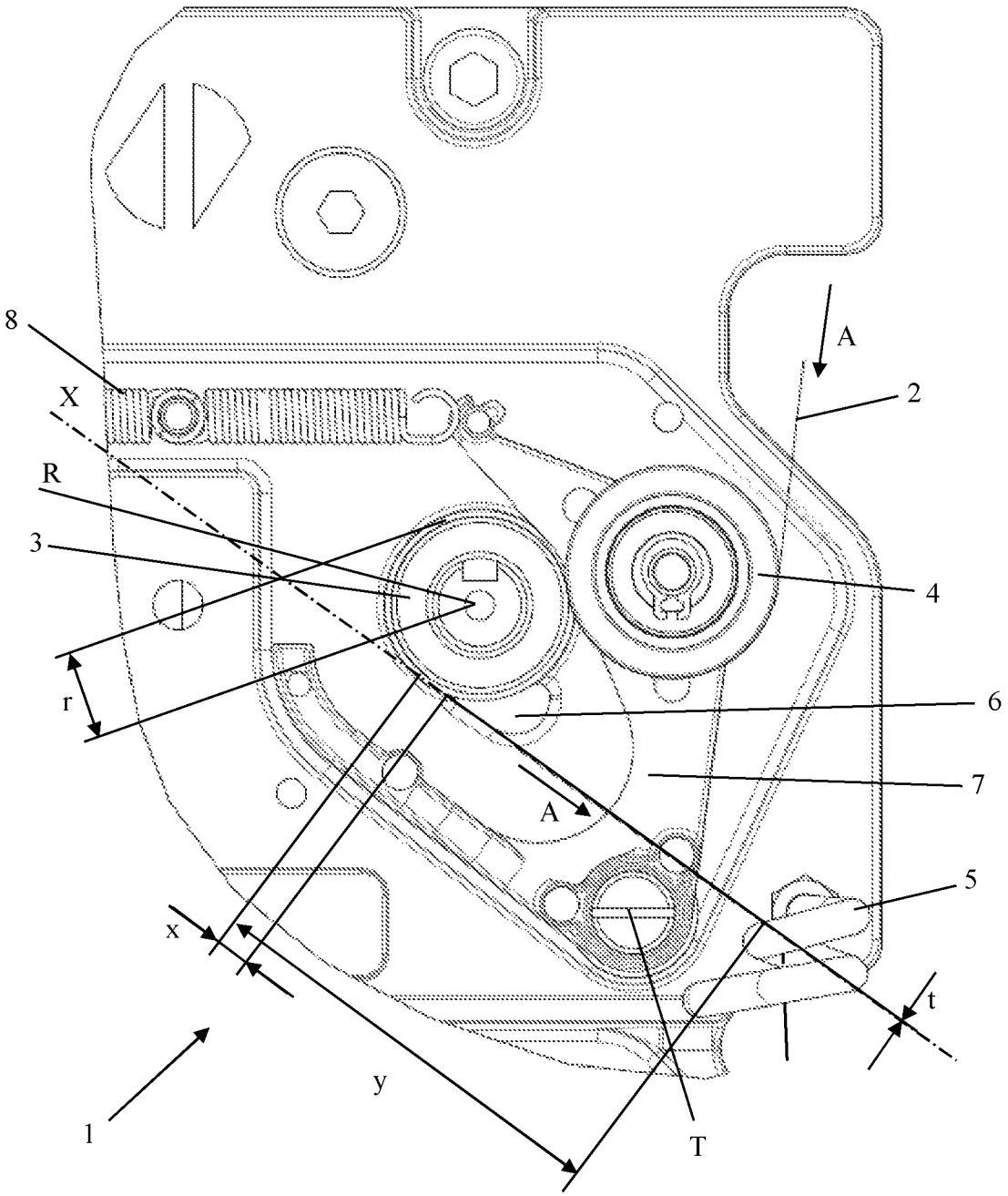
FIG. 7 shows a front view of a part of a feed device at the position of a fourth embodiment of a yarn feed module according to this disclosure.
Figure 8:
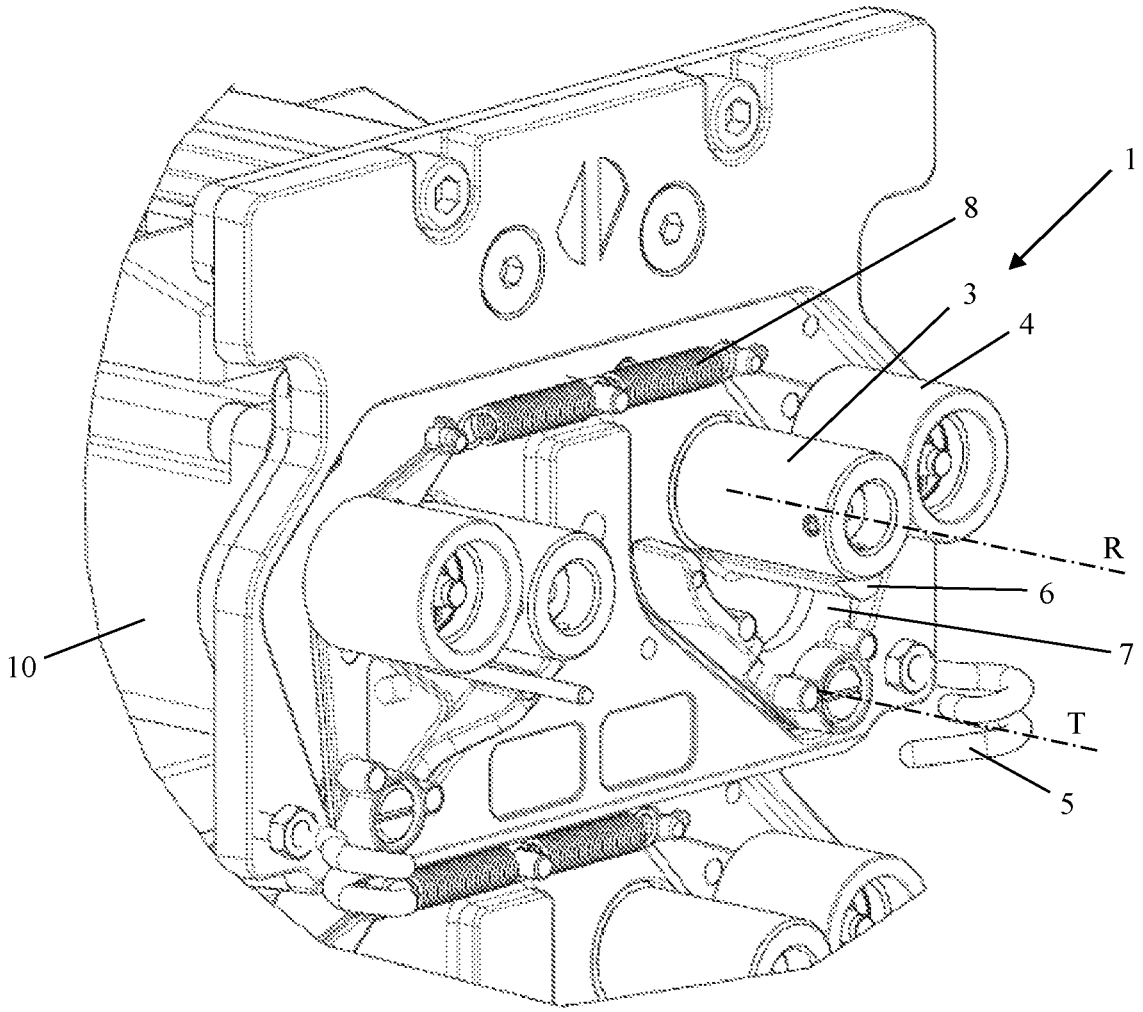
FIG. 8 shows separately and in perspective a part of the feed device from FIG. 7 at the position of the fourth embodiment.

FIG. 6 shows a yarn feed module (1) according to the first embodiment (left) and a yarn feed module (1) according to the third embodiment (right). In the fourth embodiment in FIG. 7, the mainly cylindrical pin from the third embodiment has been replaced by a pin with a wedge-shaped cross section. FIG. 8 shows a yarn feed module (1) according to the first embodiment (left) and a yarn feed module (1) according to the fourth embodiment (right).

In the embodiments shown, the pins (6) each have a height which corresponds at least to the height of the mantle surface of the drive roller (3).

In all embodiments shown, viewed in a projection plane perpendicular to the rotation axis (R) of the drive roller (3), on supplying of the yarn (2), said yarn is supplied along a common tangent (X) of the drive roller (3) and the guide element (5), as shown in FIGS. 2, 4, 5 and 7. Viewed in this projection plane, the restrain element (6) is also arranged on the same side of the tangent (X) as the drive roller (3).

In the first, second and third embodiments, said restrain element (6) is arranged at a positive intermediate distance t from the tangent (X) ($t>0$) which is less than the radius r of the drive roller (3) ($t<r$). In the fourth embodiment, said restrain element (6) touches this tangent (X) without intermediate distance ($t=0$).

In each case, the point of the restrain element (6) which is arranged closest to the tangent (X) is arranged at a distance x from the contact point of the tangent (X) with the drive roller (3), wherein this distance x is much smaller than the distance y from the contact point of the tangent (X) with the drive roller (3) to the contact point of the guide element (5) with the tangent (X). In the first, second and third embodiments, x is around one quarter of y. In the fourth embodiment, x is approximately one twelfth of y.

The invention claimed is:

1. A yarn feed module, comprising:

a drive roller that is (i) arranged so as to be rotatable around a rotation axis, (ii) drivable for supplying yarn, and (iii) configured such that the yarn is provided to detach from the drive roller on a side of the drive roller where the drive roller is arranged so as to be free;

a guide element which is arranged behind the drive roller viewed in a supply direction, the supply direction being a direction in which yarn is supplied, under a yarn tension, from the yarn feed module into a textile machine, wherein the guide element, during supplying of the yarn, guides the yarn by contact therewith so that the supply direction is adjusted by the guide element, wherein the yarn feed module has a restrain element which, viewed in the supply direction, is arranged between the drive roller and the guide element in order, on supplying of the yarn, to ensure that the yarn detaches from the drive roller, wherein, viewed in a projection plane perpendicular to the rotation axis, during supplying of the yarn, the yarn is supplied between the drive roller and the guide element approximately along a common tangent of the drive roller and guide element, wherein the restrain element comprises a restrain surface, wherein, viewed in the projection plane, a majority of the restrain surface is arranged on the same side of the tangent as the drive roller, wherein the yarn feed module comprises a carrier element which is displaceable relative to the drive roller, and comprises a drive-back element for exerting a force on the carrier element in order to drive the carrier element towards the drive roller, and comprises a guide roller which is arranged on the carrier element so as to be freely rotatable around a carrier element rotation axis in order, when the carrier element is driven towards the drive roller by the drive-back element, to clamp the supplied yarn between the drive roller and the guide roller, wherein the restrain element is arranged on the carrier element.

2. The yarn feed module according to claim 1, wherein the drive roller is mainly cylindrical with a radius r, and that the restrain element is arranged at an intermediate distance t from the tangent, wherein t≤the radius r of the drive roller.

3. The yarn feed module according to claim 1, wherein the point of the restrain element which is closest to the common tangent of the drive roller and the guide element is arranged at a distance x from a contact point of the tangent with the drive roller, wherein a distance y is the distance from the contact point of the tangent with the drive roller to the contact point of the guide element with the tangent, and wherein the distance x≤half the distance y.

4. The yarn feed module according to claim 1, wherein the restrain surface is arranged parallel to the rotation axis.

5. The yarn feed module according to claim 4, wherein the restrain element is configured as a pin.

6. The yarn feed module according to claim 4, wherein, viewed in cross-section in a section perpendicular to the rotation axis, the restrain element is wedge-shaped so as to drive a wedge between the drive roller and the yarn.

7. The yarn feed module according to claim 1, wherein the restrain element is designed so as to be convex on its side pointing towards the tangent.

8. The yarn feed module according to claim 7, wherein the restrain element is configured as a pin.

9. The yarn feed module according to claim 7, wherein, viewed in cross-section in a section perpendicular to the rotation axis, the restrain element is wedge-shaped so as to drive a wedge between the drive roller and the yarn.

10. The yarn feed module according to claim 1, wherein the restrain element is arranged fixedly.

11. The yarn feed module according to claim 1, wherein the restrain element is configured such that, on supplying of the yarn, if the yarn tension remains above a supply yarn tension, the restrain element allows unhindered supplying of the yarn.

12. A textile machine, wherein the textile machine comprises a yarn feed module according to claim 1.

* * * * *